US009757623B2

(12) United States Patent
Liu et al.

(10) Patent No.: US 9,757,623 B2
(45) Date of Patent: Sep. 12, 2017

(54) THERMOPLASTIC MULTI-LAYER GOLF BALL

(71) Applicant: Feng Tay Enterprises Co., Ltd., Douliou, Yunlin County OT (TW)

(72) Inventors: Chen-Tai Liu, Yun-Lin Hsien (TW); Chien-Hsin Chou, Yun-Lin Hsien (TW)

(73) Assignee: Feng Tay Enterprises Co., Ltd., Douliou, Yunlin County (TW)

( * ) Notice: Subject to any disclaimer, the term of this patent is extended or adjusted under 35 U.S.C. 154(b) by 22 days.

(21) Appl. No.: 14/077,695

(22) Filed: Nov. 12, 2013

(65) Prior Publication Data

US 2014/0357419 A1 Dec. 4, 2014

Related U.S. Application Data

(60) Provisional application No. 61/829,287, filed on May 31, 2013.

(51) Int. Cl.
*A63B 37/06* (2006.01)
*A63B 37/00* (2006.01)

(52) U.S. Cl.
CPC ..... *A63B 37/0092* (2013.01); *A63B 37/0031* (2013.01); *A63B 37/0043* (2013.01); *A63B 37/0045* (2013.01); *A63B 37/0047* (2013.01); *A63B 37/0062* (2013.01); *A63B 37/0064* (2013.01); *A63B 37/0066* (2013.01); *A63B 37/0091* (2013.01); *A63B 37/0075* (2013.01)

(58) Field of Classification Search
USPC ..... 473/351–378
See application file for complete search history.

(56) References Cited

U.S. PATENT DOCUMENTS 6,010,412 A 1/2000 Moriyama
6,129,640 A 10/2000 Higuchi et al.
6,949,595 B2 * 9/2005 Morgan et al. ..... 524/102
7,175,543 B2 2/2007 Kennedy, III et al.
(Continued)

FOREIGN PATENT DOCUMENTS

WO 2006024036 A1 3/2006

OTHER PUBLICATIONS

Written Opinion and International Search Report for PCT/US2014/039485 dated Sep. 17, 2014.
(Continued)

*Primary Examiner* — Alvin Hunter
(74) *Attorney, Agent, or Firm* — Anna M. Budde; Jonathan P. O'Brien; Honigman Miller Schwartz and Cohn LLP

(57) ABSTRACT

A thermoplastic multi-layer golf ball has a core center including a first thermoplastic material, a core layer including a second thermoplastic material, and a cover including a third thermoplastic material. The core center has a diameter of 21-29 mm and a surface Shore D hardness H1 of less than about 50. The core layer is at least about 5 mm thick with an outer surface Shore D hardness H2 of more than about 50. The cover has an outer surface Shore D hardness H3 of more than about 60. H3 is up to about 20 Shore D units higher than H2, and H2 is up to about 10 Shore D units higher than H1. The core layer has a specific gravity that is at least 0.1 g/cm$^3$ greater than the specific gravity of the core center.

11 Claims, 1 Drawing Sheet

(56) References Cited

U.S. PATENT DOCUMENTS

| | | | | |
|---|---|---|---|---|
| 7,312,267 | B2 * | 12/2007 | Kennedy, III | A63B 37/0031 473/372 |
| 7,357,734 | B2 | 4/2008 | Sullivan et al. | |
| 7,874,939 | B2 | 1/2011 | Sullivan et al. | |
| 8,618,197 | B2 * | 12/2013 | Sullivan et al. | 524/322 |
| 8,939,851 | B2 | 1/2015 | Hebert | |

OTHER PUBLICATIONS

PCT International Preliminary Report on Patentability CHII for PCT/US2014/039485, dated Apr. 23, 2015, 10 pgs.

* cited by examiner

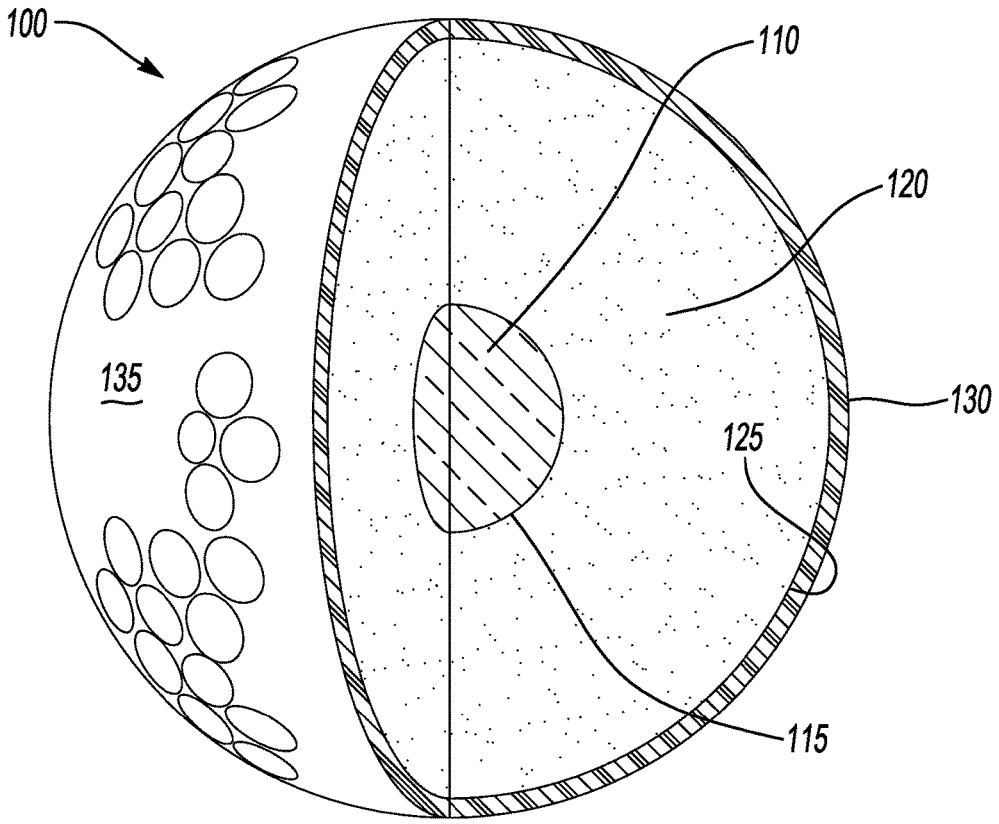
100
110
120
135
130
125
115

THERMOPLASTIC MULTI-LAYER GOLF BALL

This application claims the benefit of U.S. Provisional Application 61/829,287, filed May 31, 2013, which is hereby incorporated by reference in its entirety.

FIELD OF THE INVENTION

The invention concerns multi-layer golf balls in which the layers have different hardnesses.

BACKGROUND

This section provides information helpful in understanding the invention but that is not necessarily prior art.

Golf ball core and cover layers are typically constructed with polymer compositions including, for example, polybutadiene rubber, polyurethanes, polyamides, ionomers, and blends of such polymers. Ionomers, particularly ethylene-based ionomers, are a preferred group of polymers for golf ball layers because of their toughness, durability, and wide range of hardness values.

Golf ball compositions comprising highly neutralized acid polymers are known. For example, U.S. Pat. No. 7,375,151, the entire disclosure of which is incorporated herein by reference, discloses a highly-resilient thermoplastic ionomer resin composition comprising (a) melt-processable, ethylene acid copolymer; (b) aliphatic, mono-functional organic acid or its salt; (c) a thermoplastic resin; (d) a cation source; and (e) optionally, a filler. The ionomer resin may be neutralized to greater than 90% of all the acid groups present and remain melt-processable. The patent discloses using the highly-resilient thermoplastic composition in one-piece, two-piece, three-piece, and multi-layered golf balls.

Construction of a thermoplastic ball, in which all layers are thermoplastic, must provide good performance characteristics to compete with rubber-containing golf balls. While various uses for highly neutralized acid polymers in golf balls have been discovered, there is a need to improve golf ball characteristics when using combinations of thermoplastic polymers to provide golf ball constructions having desirable spin, feel, and COR properties.

SUMMARY OF THE DISCLOSURE

This section provides a general summary of the disclosure and is not comprehensive of its full scope or all of the disclosed features.

Disclosed is a thermoplastic multi-layer golf ball having a core center including a first thermoplastic material, a core layer including a second thermoplastic material, the core layer being disposed radially outward from and enclosing the core center, and a cover including a third thermoplastic material, the cover being disposed radially outwardly from the core layer and forming an outer structural layer of the ball. The core center has a diameter of from about 21 mm to about 29 mm and a surface Shore D hardness H1 of less than about 50. The core layer has a thickness of at least about 5 mm and an outer surface Shore D hardness H2 of more than about 50. The cover has an outer surface Shore D hardness H3 of more than about 60. The cover surface hardness H3 is harder than the core layer surface hardness H2 by up to about 20 Shore D units, and the core layer surface hardness H2 is harder than the core center surface hardness H1 by up to about 10 Shore D units. Finally, the core layer has a specific gravity that is at least 0.1 g/cm$^3$ greater than the specific gravity of the core center.

The golf ball has a multi-layer core including a core center as an innermost core part and one or more "core layers" outward from and enclosing the center. A "core layer" for this invention is a golf ball layer lying between the center and the two outermost layers of the golf ball. In describing this invention, a "cover" is the outermost structural golf ball layer of the ball or, for two cover layers, each "cover layer" is one of the two outermost structural golf ball layers. Coating layers (whether paint layers or clear coating layers) are not considered to be structural layers.

Hardness is measured according to ASTM D2240, but measured on a curved surface of the core center and core layer or on a land area of a curved surface of the cover. It is understood in this technical field of art that the hardness measured in this way often varies from the hardness of a flat slab or button of material in a non-linear way that cannot be correlated, for example because of effects of underlying layers. Because of the curved surface, care must be taken to center the golf ball or golf ball subassembly under the durometer indentor before a surface hardness reading is obtained and to measure an even area, e.g. on the dimpled surface cover measurements are taken on a land (fret) area between dimples. Specific gravity is measured according to ASTM D792. "Compression deformation" is the deformation amount in millimeters under a compressive load of 130 kg minus the deformation amount in millimeters under a compressive load of 10 kg. The amount of deformation of the ball under a force of 10 kg is measured, then the force is increased to 130 kg and the amount of deformation under the new force of 130 kg is measured. The deformation amount at 10 kg is subtracted from the deformation amount at 130 kg to give the 10-130 kg compression deformation, which is reported in millimeters. "Coefficient of restitution" or COR in the present invention is measured generally according to the following procedure: a golf ball is fired by an air cannon at an initial velocity of 40 msec, and a speed monitoring device is located over a distance of 0.6 to 0.9 meters from the cannon. After striking a steel plate positioned about 1.2 meters away from the air cannon, the test object rebounds through the speed-monitoring device. The return velocity divided by the initial velocity is the COR.

"A," "an," "the," "at least one," and "one or more" are used interchangeably to indicate that at least one of the item is present; the indefinite articles indicate a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiments. In this description of the invention, for convenience, "polymer" and "resin" are used interchangeably to encompass resins, oligomers, and polymers. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

It should be understood that the description and specific examples are intended for purposes of illustration only and are not intended to limit the scope of the claims.

BRIEF DESCRIPTION OF THE DRAWINGS

The drawing illustrates some aspects of the disclosed technology, where

The FIGURE is a cross-sectional view of an embodiment of a multi-layer golf ball of the invention. The parts of the figures are not necessarily to scale.

DETAILED DESCRIPTION

A detailed description of exemplary, nonlimiting embodiments follows.

As shown in the FIGURE, a multi-layer golf ball 100 has a core center 110 with a surface 115, a core layer 120 with a surface 125 that is radially outward from the core center 110, and a cover 130 with a surface 135 that forms the outermost layer of the golf ball 100. Each of the core center, the core layer, and the cover includes a thermoplastic material. In preferred embodiments, the golf ball is free from any thermoset rubber layer or other thermoset layer.

Multi-Layer Core

The golf ball has a multi-layer core including at least a core center and a core layer disposed radially outward from and enclosing the core center. The core center includes a first thermoplastic material, and the core layer includes a second thermoplastic material. Each of the first and second thermoplastic materials has at least one thermoplastic polymer, and in preferred embodiments each includes at least one thermoplastic elastomer. The first and second thermoplastic materials may also include one or more non-elastomeric polymers, fillers, and customary additives. The hardnesses and specific gravities of the core center and the core layer are determined by a combination of factors, including the nature and amount of thermoplastic elastomers in the first thermoplastic material, the presence, nature, and amount of other polymeric materials, and the presence, nature, and amount of fillers. The components of the first and second thermoplastic materials, particularly the polymers and the type and amount of any filler, are selected and apportioned so that the core center has a surface hardness H1 of less than about 50 Shore D, the core layer has a surface hardness H2 of more than about 50 Shore D, the core layer surface hardness H2 is up to about 10 Shore D units higher than the core center surface hardness H1, and the core layer has a specific gravity that is at least 0.1 g/cm$^3$ greater than the specific gravity of the core center.

The first and second thermoplastic materials generally include at least one thermoplastic elastomer. Nonlimiting examples of suitable thermoplastic elastomers that can be used in making the core center and core layer include metal cation ionomers of addition copolymers, metallocene-catalyzed block copolymers of ethylene and α-olefins having 4 to about 8 carbon atoms, thermoplastic polyamide elastomers (PEBA or polyether block polyamides), thermoplastic polyester elastomers, thermoplastic styrene block copolymer elastomers such as poly(styrene-butadiene-styrene), poly(styrene-ethylene-co-butylene-styrene), and poly(styrene-isoprene-styrene), thermoplastic polyurethane elastomers, thermoplastic polyurea elastomers, and dynamic vulcanizates of rubbers in these thermoplastic elastomers and in other thermoplastic matrix polymers.

Ionomer resins, which are metal cation ionomers of addition copolymers of ethylenically unsaturated acids, are preferably alpha-olefin, particularly ethylene, copolymers with $C_3$ to $C_8$ α,β-ethylenically unsaturated carboxylic acids, particularly acrylic or methacrylic acid. The copolymers may also contain a softening monomer such as an alkyl acrylate or methacrylate, for example a $C_1$ to $C_8$ alkyl acrylate or methacrylate ester. The α,β-ethylenically unsaturated carboxylic acid monomer may be from about 4 weight percent or about 6 weight percent or about 8 weight percent up to about 20 weight percent or up to about 35 weight percent of the copolymer, and the softening monomer, when present, is preferably present in a finite amount, preferably at least about 5 weight percent or at least about 11 weight percent, up to about 23 weight percent or up to about 25 weight percent or up to about 50 weight percent of the copolymer.

Nonlimiting specific examples of acid-containing ethylene copolymers include copolymers of ethylene/acrylic acid/n-butyl acrylate, ethylene/methacrylic acid/n-butyl acrylate, ethylene/methacrylic acid/isobutyl acrylate, ethylene/acrylic acid/isobutyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include copolymers of ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate. In various embodiments the most preferred acid-containing ethylene copolymers include ethylene/(meth)acrylic acid/n-butyl acrylate, ethylene/(meth)acrylic acid/ethyl acrylate, and ethylene/(meth)acrylic acid/methyl acrylate copolymers.

The ionomer resin may be a high acid ionomer resin. In general, ionomers prepared by neutralizing acid copolymers including at least about 16 weight % of copolymerized acid residues based on the total weight of the unneutralized ethylene acid copolymer are considered "high acid" ionomers. In these high modulus ionomers, the acid monomer, particularly acrylic or methacrylic acid, is present in about 16 to about 35 weight %. In various embodiments, the copolymerized carboxylic acid may be from about 16 weight %, or about 17 weight % or about 18.5 weight % or about 20 weight % up to about 21.5 weight % or up to about 25 weight % or up to about 30 weight % or up to about 35 weight % of the unneutralized copolymer. A high acid ionomer may be combined with a "low acid" ionomer in which the copolymerized carboxylic acid is less than 16 weight % of the unneutralized copolymer.

The acid moiety in the ethylene-acid copolymer is neutralized by any metal cation. Suitable preferred cations include lithium, sodium, potassium, magnesium, calcium, barium, lead, tin, zinc, aluminum, or a combination of these cations; in various embodiments alkali metal, alkaline earth metal, or zinc cations are particularly preferred. In various embodiments, the acid groups of the ionomer may be neutralized from about 10% or from about 20% or from about 30% or from about 40% to about 60% or to about 70% or to about 75% or to about 80% or to about 90%.

A sufficiently high molecular weight, monomeric organic acid or salt of such an organic acid may be added to the acid copolymer or ionomer so that the acid copolymer or ionomer can be neutralized, without losing processability, to a level above the level that would cause the ionomer alone to become non-melt-processable. The high-molecular weight, monomeric organic acid its salt may be added to the ethylene-unsaturated acid copolymers before they are neutralized or after they are optionally partially neutralized to a level between about 1 and about 100%, provided that the level of neutralization is such that the resulting ionomer remains melt-processable. In generally, when the high-molecular weight, monomeric organic acid is included the acid groups of the copolymer may be neutralized from at least about 40 to about 100%, preferably from at least about 90% to about 100%, and most preferably 100% without losing processability. Such high neutralization, particularly to levels greater than 80%, greater than 90% or greater than 95% or most preferably 100%, without loss of processability can be done by (a) melt-blending the ethylene α,β-ethylenically unsaturated carboxylic acid copolymer or a melt-processable salt of the copolymer with an organic acid or a salt of organic acid, and (b) adding a sufficient amount of a cation source up to 110% of the amount needed to neutralize the total acid in the copolymer or ionomer and organic acid or salt to the desired level to increase the level of neutralization of all the acid moieties in the mixture preferably to greater than 90%, preferably greater than 95%, or preferably to 100%. To obtain 100% neutralization, it is preferred to add a slight excess of up to 110% of cation source over the amount stoichiometrically required to obtain the 100% neutralization.

The high molecular weight, monomeric saturated or unsaturated acid may have from 8 or 12 or 18 carbon atoms to 36 carbon atoms or to less than 36 carbon atoms. Nonlimiting suitable examples of the high-molecular weight, monomeric saturated or unsaturated organic acids include stearic, behenic, erucic, oleic, and linoleic acids and their salts, particularly the barium, lithium, sodium, zinc, bismuth, chromium, cobalt, copper, potassium, strontium, titanium, tungsten, magnesium, or calcium salts of these fatty acids. These may be used in combinations.

Grades of ionomer resins are commercially available from DuPont, Wilmington, Del. under the trademark Surlyn® with hardnesses from about 35-70 Shore D.

Thermoplastic polyolefin elastomers may also be used. These are metallocene-catalyzed block copolymers of ethylene and α-olefins having 4 to about 8 carbon atoms prepared by single-site metallocene catalysis of ethylene with a softening comonomer such as hexane-1 or octene-1, for example in a high pressure process in the presence of a catalyst system comprising a cyclopentadienyl-transition metal compound and an alumoxane. Octene-1 is a preferred comonomer to use. These materials are commercially available from ExxonMobil under the tradename Exact™ and from the Dow Chemical Company under the tradename Engage™. Thermoplastic polyolefin elastomers may be made with hardness at least from about 35 Shore A to about 50 Shore D.

In various embodiments, the thermoplastic material includes a combination of a metal ionomer of a copolymer of ethylene and at least one of acrylic acid and methacrylic acid, a metallocene-catalyzed copolymer of ethylene and an α-olefin having 4 to about 8 carbon atoms, and a metal salt of an unsaturated fatty acid. This material may be prepared as described in Statz et al., U.S. Pat. No. 7,375,151 or as described in Kennedy, "Process for Making Thermoplastic Golf Ball Material and Golf Ball with Thermoplastic Material, U.S. patent application Ser. No. 13/825,112, filed 15 Mar. 2013, the entire contents of both being incorporated herein by reference.

Suitable thermoplastic styrene block copolymer elastomers include poly(styrene-butadiene-styrene), poly(styrene-ethylene-co-butylene-styrene), poly(styrene-isoprene-styrene), and poly(styrene-ethylene-co-propylene) copolymers. These styrenic block copolymers may be prepared by living anionic polymers with sequential addition of styrene and the diene forming the soft block, for example using butyl lithium as initiator. Thermoplastic styrene block copolymer elastomers are commercially available, for example, under the trademark Kraton™ sold by Kraton Polymers U.S. LLC, Houston, Tex. with hardnesses ranging from 46 to 89 Shore A (approximately 10 to 40 Shore D). Other styrene block copolymer elastomers are commercially available with hardnesses at least up to about 60 Shore D. Other such elastomers may be made as block copolymers by using polymerizable non-rubber monomers in place of the styrene, including meth(acrylate) esters such as methyl methacrylate and cyclohexyl methacrylate, and other vinyl arylenes, such as alkyl styrenes.

Thermoplastic polyurethane elastomers such as thermoplastic polyester-polyurethanes, polyether-polyurethanes, and polycarbonate-polyurethanes may be used including, without limitation, polyurethanes polymerized using as polymeric diol reactants polyethers and polyesters including polycaprolactone polyesters. These polymeric diol-based polyurethanes are prepared by reaction of the polymeric diol (polyester diol, polyether diol, polycaprolactone diol, polytetrahydrofuran diol, or polycarbonate diol), one or more polyisocyanates, and, optionally, one or more chain extension compounds. Chain extension compounds, as the term is being used, are compounds having two or more functional groups reactive with isocyanate groups, such as the diols, amino alcohols, and diamines. Preferably the polymeric diol-based polyurethane is substantially linear (i.e., substantially all of the reactants are difunctional).

Diisocyanates used in making the polyurethane elastomers may be aromatic or aliphatic. Useful diisocyanate compounds used to prepare thermoplastic polyurethanes include, without limitation, isophorone diisocyanate (IPDI), methylene bis-4-cyclohexyl isocyanate ($H_{12}$MDI), cyclohexyl diisocyanate (CHDI), m-tetramethyl xylene diisocyanate (m-TMXDI), p-tetramethyl xylene diisocyanate (p-TMXDI), 4,4'-methylene diphenyl diisocyanate (MDI, also known as 4,4'-diphenylmethane diisocyanate), 2,4- or 2,6-toluene diisocyanate (TDI), ethylene diisocyanate, 1,2-diisocyanatopropane, 1,3-diisocyanatopropane, 1,6-diisocyanatohexane (hexamethylene diisocyanate or HDI), 1,4-butylene diisocyanate, lysine diisocyanate, meta-xylylenediioscyanate and para-xylylenediisocyanate (XDI), 4-chloro-1,3-phenylene diisocyanate, 1,5-tetrahydro-naphthalene diisocyanate, 4,4'-dibenzyl diisocyanate, and combinations of these. Nonlimiting examples of higher-functionality polyisocyanates that may be used in limited amounts to produce branched thermoplastic polyurethanes (optionally along with monofunctional alcohols or monofunctional isocyanates) include 1,2,4-benzene triisocyanate, 1,3,6-hexamethylene triisocyanate, 1,6,11-undecane triisocyanate, bicycloheptane triisocyanate, triphenylmethane-4,4',4"-triisocyanate, isocyanurates of diisocyanates, biurets of diisocyanates, allophanates of diisocyanates, and the like.

Nonlimiting examples of suitable diols that may be used as extenders include ethylene glycol and lower oligomers of ethylene glycol including diethylene glycol, triethylene glycol, and tetraethylene glycol; propylene glycol and lower oligomers of propylene glycol including dipropylene glycol, tripropylene glycol, and tetrapropylene glycol; cyclohexanedimethanol, 1,6-hexanediol, 2-ethyl-1,6-hexanediol, 1,4-butanediol, 2,3-butanediol, 1,5-pentanediol, 1,3-propanediol, butylene glycol, neopentyl glycol, dihydroxyalkylated aromatic compounds such as the bis(2-hydroxyethyl) ethers of hydroquinone and resorcinol; p-xylene-α,β-diol; the bis(2-hydroxyethyl)ether of p-xylene-α,β-diol; m-xylene-α,β-diol, and combinations of these. Other active hydrogen-containing chain extenders that contain at least two active hydrogen groups may be used, for example, dithiols, diamines, or compounds having a mixture of hydroxyl, thiol, and amine groups, such as alkanolamines, aminoalkyl mercaptans, and hydroxyalkyl mercaptans, among others. Suitable diamine extenders include, without limitation, ethylene diamine, diethylene triamine, triethylene tetraamine, and combinations of these. Other typical chain extenders are amino alcohols such as ethanolamine, propanolamine, butanolamine, and combinations of these. The molecular weights of the chain extenders preferably range from about 60 to about 400. Alcohols and amines are preferred.

In addition to difunctional extenders, a small amount of a trifunctional extender such as trimethylolpropane, 1,2,6-hexanetriol and glycerol, or monofunctional active hydrogen compounds such as butanol or dimethylamine, may also be included. The amount of trifunctional extender or monofunctional compound employed may be, for example, 5.0 equivalent percent or less based on the total weight of the reaction product and active hydrogen containing groups used.

The polyester diols used in forming a thermoplastic polyurethane elastomer are in general prepared by the condensation polymerization of one or more polyacid compounds and one or more polyol compounds. Preferably, the polyacid compounds and polyol compounds are di-functional, i.e., diacid compounds and diols are used to prepare substantially linear polyester diols, although minor amounts of mono-functional, tri-functional, and higher functionality materials can be included to provide a slightly branched, but uncrosslinked polyester polyol component. Suitable dicarboxylic acids include, without limitation, glutaric acid, succinic acid, malonic acid, oxalic acid, phthalic acid, isophthalic acid, hexahydrophthalic acid, adipic acid, maleic acid, suberic acid, azelaic acid, dodecanedioic acid, their anhydrides and polymerizable esters (e.g., methyl esters) and acid halides (e.g., acid chlorides), and mixtures of these. Suitable polyols include those already mentioned, especially the diols. Typical catalysts for the esterification polymerization are protonic acids, Lewis acids, titanium alkoxides, and dialkyltin oxides.

A polymeric polyether or polycaprolactone diol reactant for preparing thermoplastic polyurethane elastomers may be obtained by reacting a diol initiator, e.g., 1,3-propanediol or ethylene or propylene glycol, with a lactone or alkylene oxide chain-extension reagent. Lactones that can be ring opened by an active hydrogen are well-known in the art. Examples of suitable lactones include, without limitation, ε-caprolactone, γ-caprolactone, β-butyrolactone, β-propriolactone, γ-butyrolactone, α-methyl-γ-butyrolactone, β-methyl-γ-butyrolactone, γ-valerolactone, δ-valerolactone, γ-decanolactone, δ-decanolactone, γ-nonanoic lactone, γ-octanoic lactone, and combinations of these. In one preferred embodiment, the lactone is ε-caprolactone. Useful catalysts include those mentioned above for polyester synthesis. Alternatively, the reaction can be initiated by forming a sodium salt of the hydroxyl group on the molecules that will react with the lactone ring. In other embodiments, a diol initiator may be reacted with an oxirane-containing compound or cyclic ether to produce a polyether diol to be used in the polyurethane elastomer polymerization. Alkylene oxide polymer segments include, without limitation, the polymerization products of ethylene oxide, propylene oxide, 1,2-cyclohexene oxide, 1-butene oxide, 2-butene oxide, 1-hexene oxide, tert-butylethylene oxide, phenyl glycidyl ether, 1-decene oxide, isobutylene oxide, cyclopentene oxide, 1-pentene oxide, and combinations of these. The oxirane- or cyclic ether-containing compound is preferably selected from ethylene oxide, propylene oxide, butylene oxide, tetrahydrofuran, and combinations of these. The alkylene oxide polymerization is typically base-catalyzed. The polymerization may be carried out, for example, by charging the hydroxyl-functional initiator compound and a catalytic amount of caustic, such as potassium hydroxide, sodium methoxide, or potassium tert-butoxide, and adding the alkylene oxide at a sufficient rate to keep the monomer available for reaction. Two or more different alkylene oxide monomers may be randomly copolymerized by coincidental addition or polymerized in blocks by sequential addition. Homopolymers or copolymers of ethylene oxide or propylene oxide are preferred. Tetrahydrofuran may be polymerized by a cationic ring-opening reaction using such counterions as $SbF_6^-$, $AsF_6^-$, $PF_6^-$, $SbCl_6^-$, $BF_4^-$, $CF_3SO_3^-$, $FSO_3^-$, and $ClO_4^-$. Initiation is by formation of a tertiary oxonium ion. The polytetrahydrofuran segment can be prepared as a "living polymer" and terminated by reaction with the hydroxyl group of a diol such as any of those mentioned above. Polytetrahydrofuran is also known as polytetramethylene ether glycol (PTMEG).

Aliphatic polycarbonate diols that may be used in making a thermoplastic polyurethane elastomer may be prepared by the reaction of diols with dialkyl carbonates (such as diethyl carbonate), diphenyl carbonate, or dioxolanones (such as cyclic carbonates having five- and six-member rings) in the presence of catalysts like alkali metal, tin catalysts, or titanium compounds. Useful diols include, without limitation, any of those already mentioned. Aromatic polycarbonates are usually prepared from reaction of bisphenols, e.g., bisphenol A, with phosgene or diphenyl carbonate.

In various embodiments, the polymeric diol preferably has a weight average molecular weight of at least about 500, more preferably at least about 1000, and even more preferably at least about 1800 and a weight average molecular weight of up to about 10,000, but polymeric diols having weight average molecular weights of up to about 5000, especially up to about 4000, may also be preferred. The polymeric diol advantageously has a weight average molecular weight in the range from about 500 to about 10,000, preferably from about 1000 to about 5000, and more preferably from about 1500 to about 4000. The weight average molecular weights may be determined by ASTM D-4274.

The reaction of the polyisocyanate, polymeric diol, and diol or other chain extension agent is typically carried out at an elevated temperature in the presence of a catalyst. Typical catalysts for this reaction include organotin catalysts such as stannous octoate, dibutyl tin dilaurate, dibutyl tin diacetate, dibutyl tin oxide, tertiary amines, zinc salts, and manganese salts. Generally, for elastomeric polyurethanes, the ratio of polymeric diol, such as polyester diol, to extender can be varied within a relatively wide range depending largely on the desired hardness of the final polyurethane elastomer. For example, the equivalent proportion of polyester diol to extender may be within the range of 1:0 to 1:12 and, more preferably, from 1:1 to 1:8. Preferably, the diisocyanate(s) employed are proportioned such that the overall ratio of equivalents of isocyanate to equivalents of active hydrogen containing materials is within the range of 1:1 to 1:1.05, and more preferably, 1:1 to 1:1.02. The polymeric diol segments typically are from about 35% to about 65% by weight of the polyurethane polymer, and preferably from about 35% to about 50% by weight of the polyurethane polymer.

The selection of diisocyanate, extenders, polymeric diols, and the weight percent of the polymeric diols used takes into account the desired specific gravity and hardness of the polyurethane elastomer. Elastomeric polyurethanes are available with a wide range of hardnesses, at least from about 50 Shore A to 75 Shore D.

Suitable thermoplastic polyurea elastomers may be prepared by reaction of one or more polymeric diamines or polyols with one or more of the polyisocyanates already mentioned and one or more diamine extenders. Nonlimiting examples of suitable diamine extenders include ethylene diamine, 1,3-propylene diamine, 2-methyl-pentamethylene diamine, hexamethylene diamine, 2,2,4- and 2,4,4-trimethyl-1,6-hexane diamine, imino-bis(propylamine), imido-bis(propylamine), N-(3-aminopropyl)-N-methyl-1,3-propanediamine), 1,4-bis(3-aminopropoxy)butane, diethyleneglycol-di(aminopropyl)ether), 1-methyl-2,6-diamino-cyclohexane, 1,4-diamino-cyclohexane, 1,3- or 1,4-bis(methylamino)-cyclohexane, isophorone diamine, 1,2- or 1,4-bis(sec-butylamino)-cyclohexane, N,N'-diisopropyl-isophorone diamine, 4,4'-diamino-dicyclohexylmethane, 3,3'-dimethyl-4,4'-diamino-dicyclohexylmethane, N,N'-dialkylamino-dicyclohexylmethane, and 3,3'-diethyl-5,5'-dimethyl-4,4'-diamino-dicyclohexylmethane. Polymeric diamines include polyoxyethylene diamines, polyoxypropylene diamines, poly(oxyethylene-oxypropylene)diamines, and poly(tetramethylene ether) diamines. The amine- and hydroxyl-functional extenders already mentioned may be used as well. Generally, as before, trifunctional reactants are limited and may be used in conjunction with monofunctional reactants to prevent crosslinking.

Suitable thermoplastic polyamide elastomers may be obtained by: (1) polycondensation of (a) a dicarboxylic acid, such as oxalic acid, adipic acid, sebacic acid, terephthalic acid, isophthalic acid, 1,4-cyclohexanedicarboxylic acid, or any of the other dicarboxylic acids already mentioned with (b) a diamine, such as ethylenediamine, tetramethylenediamine, pentamethylenediamine, hexamethylenediamine, or decamethylenediamine, 1,4-cyclohexanediamine, m-xylylenediamine, or any of the other diamines already mentioned; (2) a ring-opening polymerization of a cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid, or 12-aminododecanoic acid; or (4) copolymerization of a cyclic lactam with a dicarboxylic acid and a diamine to prepare a carboxylic acid-functional polyamide block, followed by reaction with a polymeric ether diol (polyoxyalkylene glycol) such as any of those already mentioned. Polymerization may be carried out, for example, at temperatures of from about 180° C. to about 300° C. Specific examples of suitable polyamide blocks include NYLON 6, NYLON 66, NYLON 610, NYLON 11, NYLON 12, copolymerized NYLON, NYLON MXD6, and NYLON 46 block copolymer elastomers. Thermoplastic poly(ether amide) block copolymer elastomers (PEBA) are commercially available under the trademark Pebax® from Arkema.

The effects of the type and molecular weights of the soft segment polymeric polyols used in making thermoplastic polyurea elastomers and polyamide elastomers are analogous to the same effects in making thermoplastic polyurethane elastomers.

Thermoplastic polyester elastomers have blocks of monomer units with low chain length that form the crystalline regions and blocks of softening segments with monomer units having relatively higher chain lengths. Thermoplastic polyester elastomers are commercially available under the trademark Hytrel® from DuPont. Grades with hardnesses of about 25 Shore D to about 70 Shore D are available.

The first and second thermoplastic materials may include other polymers. In one example, the first or second thermoplastic material may include dispersed domains of cured rubbers, which may be incorporated in a thermoplastic elastomer matrix via dynamic vulcanization of rubbers in any of these thermoplastic elastomers or in other thermoplastic polymers. One such composition is described in Voorheis et al, U.S. Pat. No. 7,148,279, which is incorporated herein by reference. In various embodiments, the first thermoplastic material may include a thermoplastic dynamic vulcanizate of a rubber in a non-elastomeric matrix resin such as polypropylene. Thermoplastic vulcanizates commercially available from ExxonMobil under the tradename Santoprene™ are believed to be vulcanized domains of EPDM in polypropylene and are available in hardnesses of 35 Shore A to 50 Shore D.

Depending on the hardness of the elastomer selected for the first thermoplastic material, one or more plasticizers may be incorporated to adjust the hardness of the first thermoplastic material to less than about 50. One example of such a plasticizer is the high molecular weight, monomeric organic acid or its salt that may be incorporated, for example, with an ionomer polymer as already described, including metal stearates such as zinc stearate, calcium stearate, barium stearate, lithium stearate and magnesium stearate. For most thermoplastic elastomers, the percentage of hard-to-soft segments is adjusted if lower hardness is desired rather than by adding a plasticizer.

The surface hardnesses and specific gravities of the core center and the core layer depend at least in part on the hardnesses and specific gravities of the polymers used in making the first and second thermoplastic materials. Various fillers may be added to the first and second thermoplastic compositions for reinforcement or to adjust the specific gravity, hardness, or other properties of the core center and core layer. Nonlimiting examples of suitable fillers include clay, talc, asbestos, graphite, glass, mica, calcium metasilicate, barium sulfate, zinc sulfide, aluminum hydroxide, silicates, diatomaceous earth, carbonates (such as calcium carbonate, magnesium carbonate and the like), metals (such as titanium, tungsten, aluminum, bismuth, nickel, molybdenum, iron, copper, brass, boron, bronze, cobalt, beryllium and alloys of these), metal oxides (such as zinc oxide, iron oxide, aluminum oxide, titanium oxide, magnesium oxide, zirconium oxide and the like), particulate synthetic plastics (such as high molecular weight polyethylene, polystyrene, polyethylene ionomeric resins and the like), particulate carbonaceous materials (such as carbon black, natural bitumen and the like), as well as cotton flock, cellulose flock and/or leather fiber. Nonlimiting examples of heavy-weight fillers that may be used to increase specific gravity include titanium, tungsten, aluminum, bismuth, nickel, molybdenum, iron, steel, lead, copper, brass, boron, boron carbide whiskers, bronze, cobalt, beryllium, zinc, tin, and metal oxides (such as zinc oxide, iron oxide, aluminum oxide, titanium oxide, magnesium oxide, zirconium oxide). Non-limiting examples of light-weight fillers that may be used to decrease specific gravity include particulate plastics, glass, ceramics, and hollow spheres, regrinds, or foams of these. Fillers that may be used in the core center and core layers of a golf ball are typically in a finely divided form.

Customary additives can also be included in the thermoplastic materials, for example dispersants, antioxidants such as phenols, phosphites, and hydrazides, processing aids, surfactants, stabilizers, and so on.

The core center has a surface Shore D hardness (H1) of less than 50. In various embodiments, the core center may have a surface hardness H1 of at least about 30 Shore D, preferably at least about 35 Shore D, more preferably at least about 40 Shore D and up to about 48 Shore D, or up to about 46 Shore D. In certain preferred embodiments the core center has a surface hardness H1 of about 40 to about 48 Shore D and more preferably of about 44 Shore D to about 46 Shore D.

The core center specific gravity may be at least about 0.85 $g/cm^3$. In various embodiments, the core center specific gravity may be from about 0.85 $g/cm^3$ or from about 0.9 $g/cm^3$ or from about 0.95 $g/cm^3$ or from about 1.0 $g/cm^3$ to about 1.05 $g/cm^3$ or to about 1.10 $g/cm^3$ or to about 1.15 $g/cm^3$ or to about 1.20 $g/cm^3$.

The core layer has a Shore D surface hardness H2 of more than about 50. In various embodiments, the core layer may have a surface hardness H2 of at least about 51 Shore D, preferably at least about 52 Shore D, and still more preferably at least about 54 Shore D and up to about 60 Shore D hardness. In preferred embodiments the surface hardness H2 may be less than about 60 Shore D, or less than about 58 Shore D, or less than about 56 Shore D hardness. In certain preferred embodiments the core layer has a surface hardness of from about 52 to about 58 Shore D and more preferably of about 54 to about 56 Shore D.

The core layer specific gravity is at least 0.1 $g/cm^3$ greater than the specific gravity of the core center. The core layer specific gravity may be at least about 0.95 $g/cm^3$. In various embodiments, the core layer specific gravity may be from about 0.95 $g/cm^3$ or from about 1.0 $g/cm^3$ or from about 1.05 $g/cm^3$ or from about 1.1 $g/cm^3$ to about 1.15 $g/cm^3$ or to about 1.2 $g/cm^3$ or to about 1.25 $g/cm^3$ or to about 1.3 $g/cm^3$.

The first and second thermoplastic materials may be made by conventional methods, such as melt mixing in a single- or twin-screw extruder, a Banbury mixer, an internal mixer, a two-roll mill, or a ribbon mixer. The first thermoplastic material is formed into a core center and the second thermoplastic material is formed into a core layer around the core center by usual methods, for example by injection molding with a mold temperature in the range of 150° C. to 230° C. If there is a second core layer, the fourth thermoplastic material may be formed in a layer over the core layer by the same methods. The molded core including core center, core layer, and optionally second core layer or further core layers, may be ground to a desired diameter after cooling. Grinding can also be used to remove flash, pin marks, and gate marks due to the molding process.

The core center has a diameter of 21 mm to 29 mm. In various embodiments, the core center may have a diameter of from about 23 mm to about 27 mm.

The core layer has a thickness of from at least about 5 mm. In various embodiments, the core layer may have a thickness of from about 5 mm to about 10 mm.

Cover

A cover layer is molded over the core. As with the core center and core layer or layers, the cover is molded from a thermoplastic material. The third thermoplastic material used to make the cover may include any of the thermoplastic elastomers already mentioned as useful in the first and second thermoplastic materials. In particular, thermoplastic polyurethane elastomers, thermoplastic polyurea elastomers, and the metal cation salts of copolymers of ethylene with ethylenically unsaturated carboxylic acids may be mentioned as preferred thermoplastic elastomers for the third thermoplastic material.

The cover may be formulated with a pigment, such as a yellow or white pigment, and in particular a white pigment such as titanium dioxide or zinc oxide. Generally titanium dioxide is used as a white pigment, for example in amounts of from about 0.5 parts by weight or 1 part by weight to about 8 parts by weight or 10 parts by weight based on 100 parts by weight of polymer. In various embodiments, a white-colored cover may be tinted with a small amount of blue pigment or brightener.

The cover may also contain one or more customary additives such as dispersants, hindered amine light stabilizers such as piperidines and oxanalides, ultraviolet light absorbers such as benzotriazoles, triazines, and hindered phenols, antioxidants such as phenols, phosphites, and hydrazides, defoaming agents, processing aids, surfactants, fluorescent materials and fluorescent brighteners, stabilizers, processing aids, and so on.

Other exemplary cover materials include dyes such as blue dye, pigments such as titanium dioxide and zinc oxide, and antistatic agents.

The cover may be formed on the multi-layer core by injection molding, compression molding, casting, and so on. For example, when the cover is formed by injection molding, a core fabricated beforehand may be set inside a mold, and the cover material may be injected into the mold. The cover is typically molded on the core by injection molding or compression molding. Alternatively, another method that may be used involves pre-molding a pair of half-covers from the cover material by die casting or another molding method, enclosing the core in the half-covers, and compression molding at, for example, between 120° C. and 170° C. for a period of 1 to 5 minutes to attach the cover halves around the core. The core may be surface-treated before the cover is formed over it to increase the adhesion between the core and the cover. Nonlimiting examples of suitable surface preparations include mechanical or chemical abrasion, corona discharge, plasma treatment, or application of an adhesion promoter such as a silane or of an adhesive. The cover typically has a dimple pattern and profile to provide desirable aerodynamic characteristics to the golf ball.

Typically, the cover may have a thickness of from about 0.5 mm to about 4 mm. If there are two cover layers, typically, the cover layers may each independently have a thickness of from about 0.6 mm to about 2.0 mm, preferably from about 0.8 mm to about 1.6 mm.

The cover has a surface Shore D hardness H3 of more than about 60. The cover surface hardness H3 is greater than the core layer surface hardness H2 by up to about 20 Shore D units. In various embodiments, the cover may have a surface hardness H3 of at least about 61 Shore D, preferably at least about 65 Shore D, and still more preferably at least about 68 Shore D. In preferred embodiments the surface hardness H3 may up to about 80 Shore D, or up to about 75 Shore D, or up to about 72 Shore D. In certain preferred embodiments the cover has a surface hardness of from about 61 to about 80 Shore D and more preferably from about 65 to about 75 Shore D.

The golf balls can be of any size, although the USGA requires that golf balls used in competition have a diameter of at least 1.68 inches (42.672 mm) and a weight of no greater than 1.62 ounces (45.926 g). For play outside of USGA competition, the golf balls can have smaller diameters and be heavier.

After a golf ball has been molded, it may undergo various further processing steps such as buffing, painting and marking. In a particularly preferred embodiment of the invention, the golf ball has a dimple pattern that coverage of 65% or more of the surface. The golf ball typically is coated with a durable, abrasion—resistant and relatively non-yellowing finish coat.

The description is merely exemplary in nature and, thus, variations that do not depart from the gist of the disclosure are a part of the invention. Variations are not to be regarded as a departure from the spirit and scope of the disclosure

What is claimed is:

1. A golf ball comprising:

a core center comprising a first thermoplastic material, wherein the core center has a diameter of from about 21 mm to about 29 mm, a specific gravity of 1.0 to 1.2, and a surface Shore D hardness (H1) of less than 50;

a core layer disposed radially outward from the core center, wherein the core layer has a thickness of at least about 5 mm, a surface Shore D hardness (H2) of more than about 50, a specific gravity of 1.1 to 1.3, and comprises a second thermoplastic material;

a cover disposed radially outward of the core layer, wherein the cover comprises a pigment and a third thermoplastic material, wherein the cover comprises 0.5 to 10 parts by weight of the pigment based on 100 parts by weight of the third thermoplastic material, and has a surface Shore D hardness (H3) of more than about 60, wherein the cover forms the outermost layer of the golf ball;

wherein the cover surface hardness H3 is up to about 20 Shore D units higher than the core layer surface hardness H2, the core layer hardness H2 is up to about 10 Shore D units higher than the core center surface hardness H1, and the specific gravity of the core layer is at least 0.1 higher than the specific gravity of the core center;

wherein at least two of the first thermoplastic material, the second thermoplastic material, and the third thermoplastic material comprise an ionomeric thermoplastic material prepared by combining and reacting (a) an unneutralized copolymer of ethylene and at least one of acrylic acid and methacrylic acid, which has from about 5 to about 10 percent by weight acid monomer, (b) a metallocene-catalyzed copolymer of ethylene and octane, (c)(1) an unsaturated, unsalted fatty acid comprising oleic acid and linoleic acid and (c)(2) a saturated fatty acid; and (d) a metal cation in an amount sufficient to neutralize from about 65 to about 90% of the acid groups, to produce the ionomeric thermoplastic material, wherein the unneutralized copolymer (a) is from about 55 to about 95 weight percent of the combined weights of the unneutralized copolymer (a) and the copolymer of ethylene and octane (b).

2. A golf ball according to claim 1, wherein H1 is at least about 30 Shore D.

3. A golf ball according to claim 1, wherein H1 is up to about 48 Shore D.

4. A golf ball according to claim 1, wherein H1 is from about 40 to about 48 Shore D.

5. A golf ball according to claim 1, wherein H2 is less than about 60 Shore D.

6. A golf ball according to claim 1, wherein H2 is from about 52 to about 58 Shore D.

7. A golf ball according to claim 1, wherein the core center has a diameter of from about 23 mm to about 27 mm.

8. A golf ball according to claim 1, wherein the core layer has a thickness of from about 5 mm to about 10 mm.

9. A golf ball according to claim 1, wherein H3 is up to about 80 Shore D.

10. A golf ball according to claim 1, wherein H3 is from about 65 to about 75 Shore D.

11. A golf ball according to claim 1, wherein the golf ball is free from a thermoset rubber layer.

* * * * *